US006560867B2

(12) United States Patent
Stretch

(10) Patent No.: US 6,560,867 B2
(45) Date of Patent: May 13, 2003

(54) MODULAR VALVETRAIN AND CYLINDER HEAD STRUCTURE

(75) Inventor: Dale A. Stretch, Novi, MI (US)

(73) Assignee: Eaton Corporation, Cleveland, OH (US)

( * ) Notice: Subject to any disclaimer, the term of this patent is extended or adjusted under 35 U.S.C. 154(b) by 22 days.

(21) Appl. No.: 09/902,315

(22) Filed: Jul. 10, 2001

(65) Prior Publication Data

US 2003/0010300 A1 Jan. 16, 2003

(51) Int. Cl.[7] ..... B23P 15/00
(52) U.S. Cl. ..... 29/888.01; 29/888.06
(58) Field of Search ..... 29/888.01, 888.06, 29/525.02; 123/193.5, 193.3

(56) References Cited

U.S. PATENT DOCUMENTS

| | | | | | |
|---|---|---|---|---|---|
| 4,259,931 | A | * | 4/1981 | Clark et al. | 123/198 F |
| 4,699,107 | A | * | 10/1987 | Jensen | 123/435 |
| 4,721,074 | A | | 1/1988 | Wirth et al. | 123/90.23 |
| 4,724,804 | A | * | 2/1988 | Wirth | 123/90.39 |
| 4,724,805 | A | * | 2/1988 | Wirth et al. | 123/90.39 |
| 5,357,921 | A | * | 10/1994 | Katoh et al. | 123/193.2 |
| 5,458,099 | A | * | 10/1995 | Koller et al. | 123/193.5 |
| 5,566,450 | A | * | 10/1996 | Rao et al. | 29/888 |
| 5,598,630 | A | * | 2/1997 | Savoyard et al. | 29/888.01 |
| 5,647,307 | A | * | 7/1997 | Clarke et al. | 123/42 |
| 5,933,950 | A | * | 8/1999 | Yuo et al. | 123/193.3 |
| 5,970,956 | A | | 10/1999 | Sturman | 123/508 |
| 6,112,393 | A | * | 9/2000 | Schlegel et al. | 29/407.01 |
| 6,125,799 | A | | 10/2000 | Von Son | 123/41.31 |
| 6,233,807 | B1 | * | 5/2001 | Werner | 29/407.02 |

* cited by examiner

*Primary Examiner*—I Cuda-Rosenbaum
(74) *Attorney, Agent, or Firm*—L. J. Kasper

(57) ABSTRACT

A method of assembling a cylinder head assembly (11) for use with a cylinder block of an internal combustion engine. The method involves providing a cylinder head slab (17) defining a pattern of intake (21) and exhaust (23) poppet valves. The head slab is provided with a plurality of bolt holes (37) defining a bolt hole pattern. Next, a plurality A and B of valve activation modules, selected from a group of possible modules (15;101;201;301) is provided, each defining a plurality of bolt holes (63;109) which correspond with at least a major portion of the bolt holes (37) in the bolt hole pattern. The next step is selecting one module (15;101;201;301) and bolting it to the cylinder head slab (17).

6 Claims, 10 Drawing Sheets

MODULAR VALVETRAIN AND CYLINDER HEAD STRUCTURE

BACKGROUND OF THE DISCLOSURE

The present invention relates to internal combustion engines, and more particularly, to such engines in which it is desirable to be able to provide different types of valve gear train for different engine applications and/or markets and/or customers.

A conventional internal combustion engine of the type to which the present invention relates includes a cylinder block defining a plurality of cylinders. Each cylinder has a piston disposed therein, such that the region of the cylinder, above the piston, comprises a combustion chamber. It will become apparent to those skilled in the art that the present invention is applicable to practically any cylinder block configuration or type. For example, the invention could be utilized advantageously with a cylinder block of either the in-line configuration or the V-type configuration, and could be utilized with a cylinder block having any number of cylinders, the most common engine types being four-, six-, and eight-cylinder engines.

Conventional internal combustion engines also include a cylinder head assembly, such assemblies typically including the cylinder head and the head cover The typical cylinder head includes the appropriate number of intake and exhaust poppet valve assemblies, which are arranged in a pattern corresponding to the pattern of cylinders and combustion chambers defined by the cylinder block. Each of the poppet valve assemblies would include, by way of example only, a valve guide fixed within a guide bore defined by the cylinder head, a poppet valve which is reciprocable within the guide, a retainer to hold a valve return spring, and the valve return spring tending to bias the poppet valve toward its closed position, as is well know to those skilled in the art.

The conventional cylinder head also includes an appropriate valve gear train, operable to impart opening and closing motion to the intake and exhaust poppet valves. For example, the cylinder head may include integrally cast portions which support a cam shaft, wherein the cam shaft includes a plurality of cam lobes, each of which is disposed to impart pivotal movement to a rocker arm, such that the pivotal movement of the rocker arm provides the opening and closing motion of its respective engine poppet valve.

Internal combustion engines of the general type described above have been in widespread use for many years and have been considered quite satisfactory, in terms of engine performance. However, there are many situations in which the engine manufacturer has a particular base engine configuration (for example, an in-line six-cylinder engine block), wherein it would be desirable for the engine OEM to be able to provide the base engine block with any one of a number of different valve gear train types. For example, the engine OEM may utilize the base engine block in several different vehicle applications, or in several different geographic markets, wherein it would be desirable to be able to provide a series of valve gear train types of varying performance capability and therefore, of varying cost.

Unfortunately, each different valve gear train type has, in the past, necessitated a different cylinder head design, tailored to the particular valve gear train type, and the provision of (and casting, machining, etc.) a series of different cylinder heads for a single engine block adds substantially to the overall cost of each resulting engine type. This is true unless the production volumes of each engine type are quite large.

In addition to providing different valve gear train types, it may be desirable for the engine OEM to be able to provide, for each valve gear train type, several other options. For example, for a certain engine block, on those cylinder heads which are equipped with a center-pivot rocker arm, overhead-cam type valve gear train, the engine OEM may wish to offer the option of either individual fuel injectors or a common rail type fuel injection system. As another example, the engine OEM may wish, for the same valve gear train type, to be able to offer the option of either a conventional lubrication system (in which the head "shares" the engine oil with the block), or a sealed, self-lubricated head (in which the cylinder head assembly has its own oil supply and pressure source).

BRIEF SUMMARY OF THE INVENTION

Accordingly, it is an object of the present invention to provide improved cylinder head assemblies which make it more economically feasible to provide several different valve gear train options for each particular base engine block.

It is a more specific object of the present invention to provide such improved cylinder head assemblies in which one part of the assembly remains common to all of the assemblies, and another part is different for each valve gear train type.

It is another object of the invention to provide an improved method of assembling a cylinder head assembly which will assist in achieving the above-stated objects.

It is another, more specific object of the present invention to provide such cylinder head assemblies wherein each valve gear train type may be provided with additional options, such as different fuel injection and lubrication options or arrangements.

The above and other objects of the invention are accomplished by the provision of an improved method of assembling a cylinder head assembly for use with a cylinder block of an internal combustion engine, the cylinder block defining a plurality of combustion chambers defining a chamber pattern.

The improved method comprises the steps of providing a cylinder head slab adapted to engage and be attached to the cylinder block and including a predetermined pattern of intake and exhaust poppet valve assemblies corresponding to the chamber pattern defined by the combustion chambers. The cylinder head slab is provided with a plurality of bolt holes defining a bolt hole pattern. The method includes providing a plurality of valve activation modules A and B in which each of said valve activation modules A and B comprises a housing and a plurality of valve actuators corresponding to the pattern of intake and exhaust poppet valve assemblies. The improved method further comprises selecting a module from the plurality of valve activation modules A and B, each of the valve activation modules defining a plurality of bolt holes which correspond with at least a major portion of the bolt holes of the bolt hole pattern defined by the cylinder head slab. Finally, the method comprises bolting the selected module A or B to the cylinder head slab.

In accordance with a further aspect of the invention, each of the valve activation modules A and B is a member selected from the group consisting of: a module having a valve gear train of the center-pivot rocker arm type, a module having a valve gear train of the camless type, a module having a valve gear train of the end-pivot rocker arm type, and a module having a valve gear train of the direct acting cam type.

DETAILED DESCRIPTION OF THE PREFERRED EMBODIMENT

Figure 3:
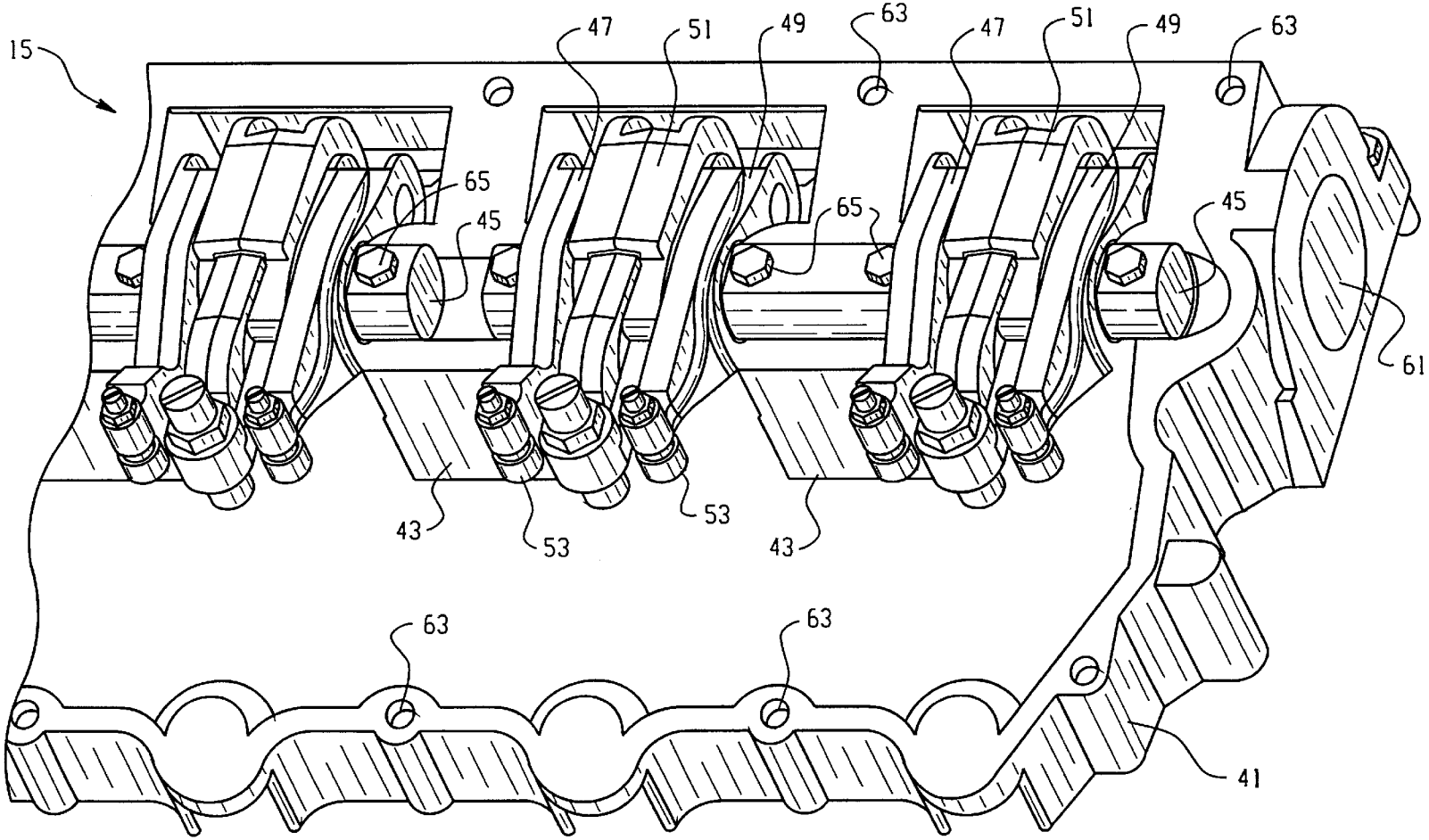
FIG. 3 is a fragmentary, perspective view, viewed in the same direction as in FIG. 1, of a valve activation module for use with the slab head assembly of FIG. 1, and on about the same scale as FIG. 1.
Figure 4:
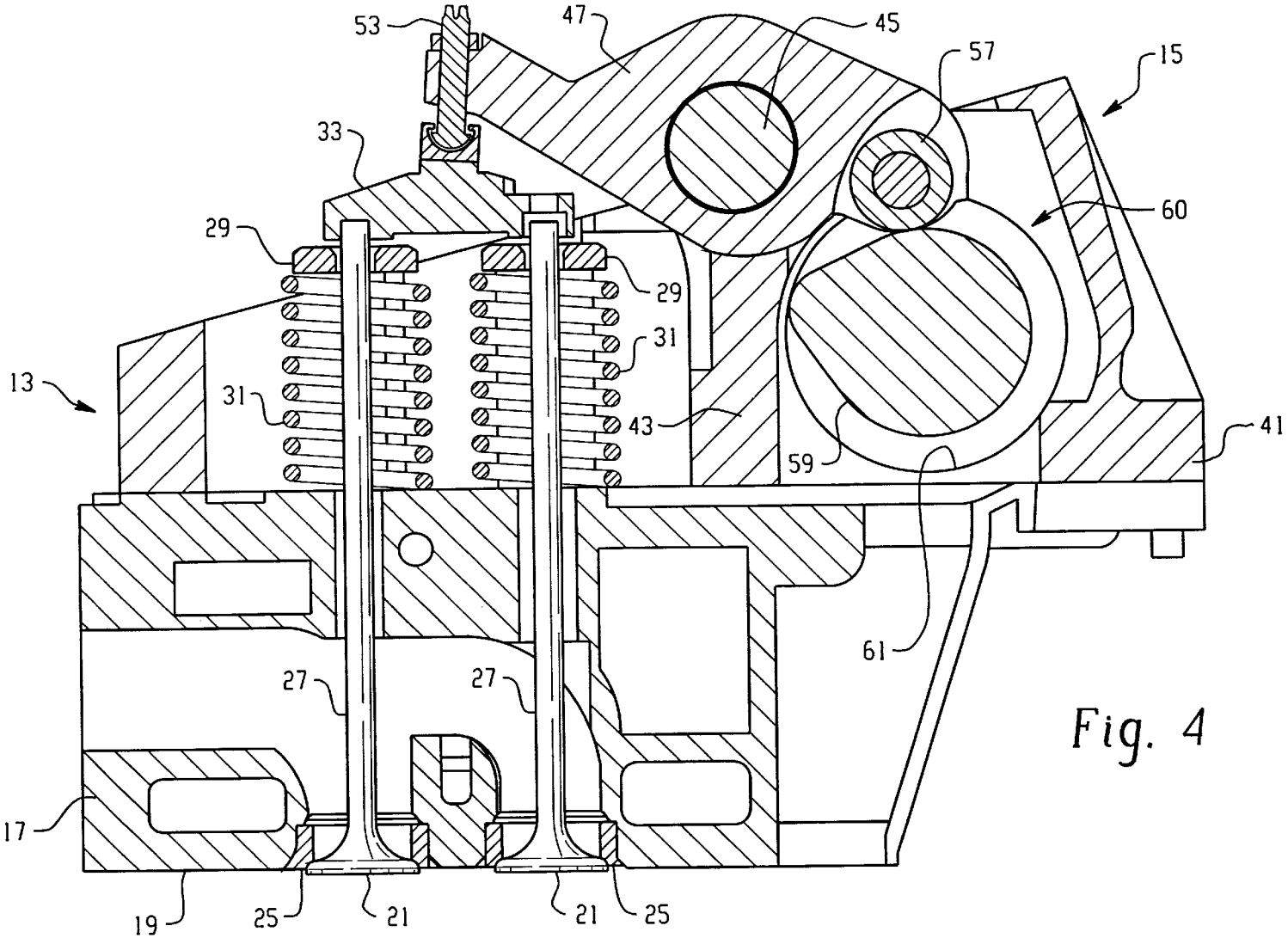
FIG. 4 is a somewhat enlarged, transverse cross-section taken on line 4—4 of FIG. 2, but with the valve activation module of FIG. 3 in place.

Referring now to the drawings, which are not intended to limit the invention, FIG. 4 illustrates in transverse cross-section a cylinder head assembly, generally designated 11 for an internal combustion engine of the type including a cylinder block, not shown herein. As is well know to those skilled in the art, a typical internal combustion engine cylinder block defines a plurality of cylinders, and in the subject embodiment, and by way of example only, the cylinder head assembly 11 is for use with an in-line, six cylinder engine. Thus, it will be understood that in the fragmentary views shown in FIGS. 1, 2 and 3, approximately one-half of the particular subassembly is visible in the particular view. The combustion chambers defined by any particular cylinder block define a chamber pattern (not shown herein, but understood by those skilled in the art), which will be referenced subsequently.

The cylinder head assembly 11, as best shown in FIG. 4, comprises a cylinder head slab subassembly, generally designated 13 (see also FIG. 1), and a valve activation module, generally designated 15 (see also FIG. 3), each of which will be described in detail separately.

Figure 1:
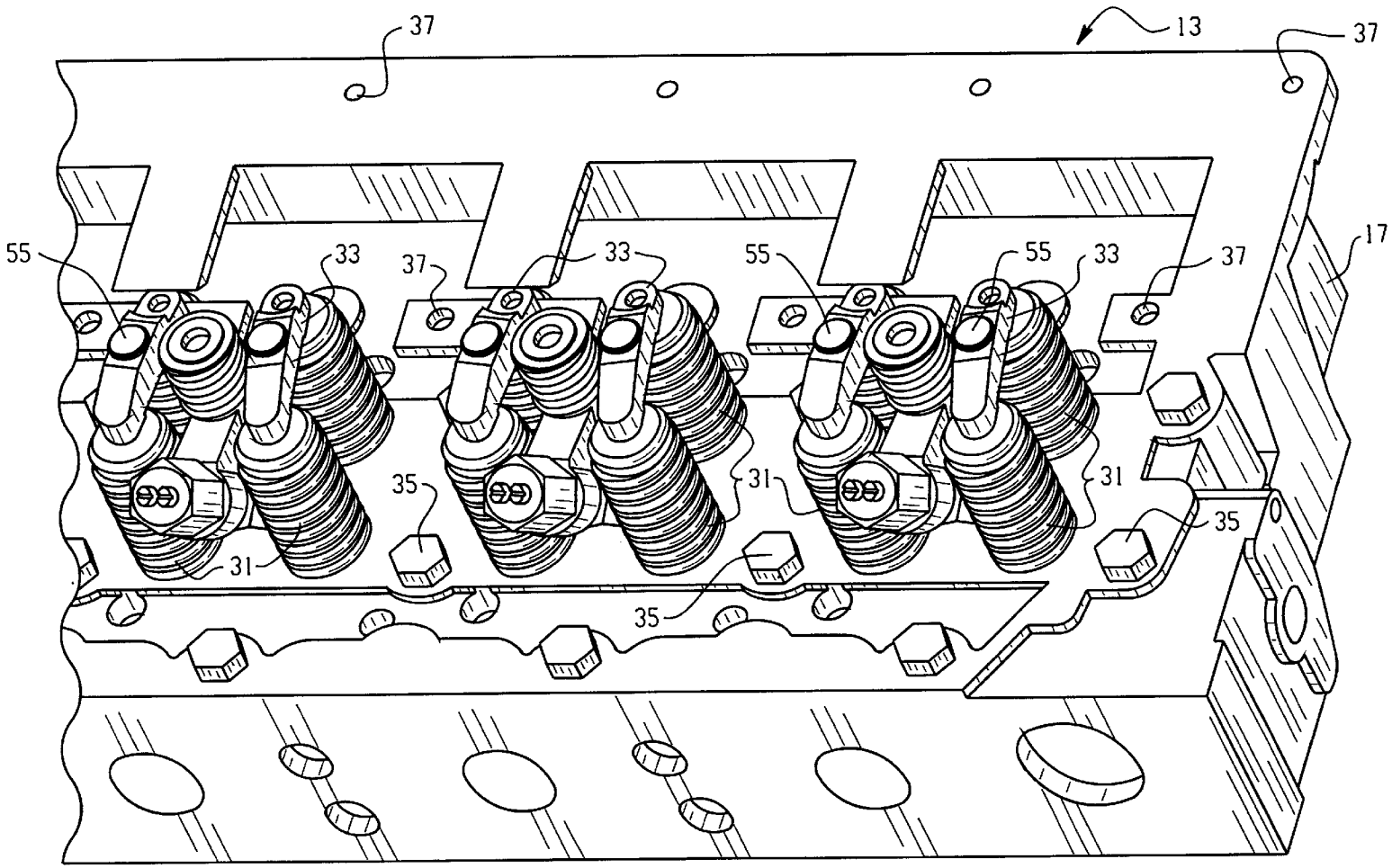
FIG. 1 is a fragmentary, perspective view of a cylinder head slab subassembly for use as part of the present invention, illustrating one embodiment of the invention.
Figure 2:
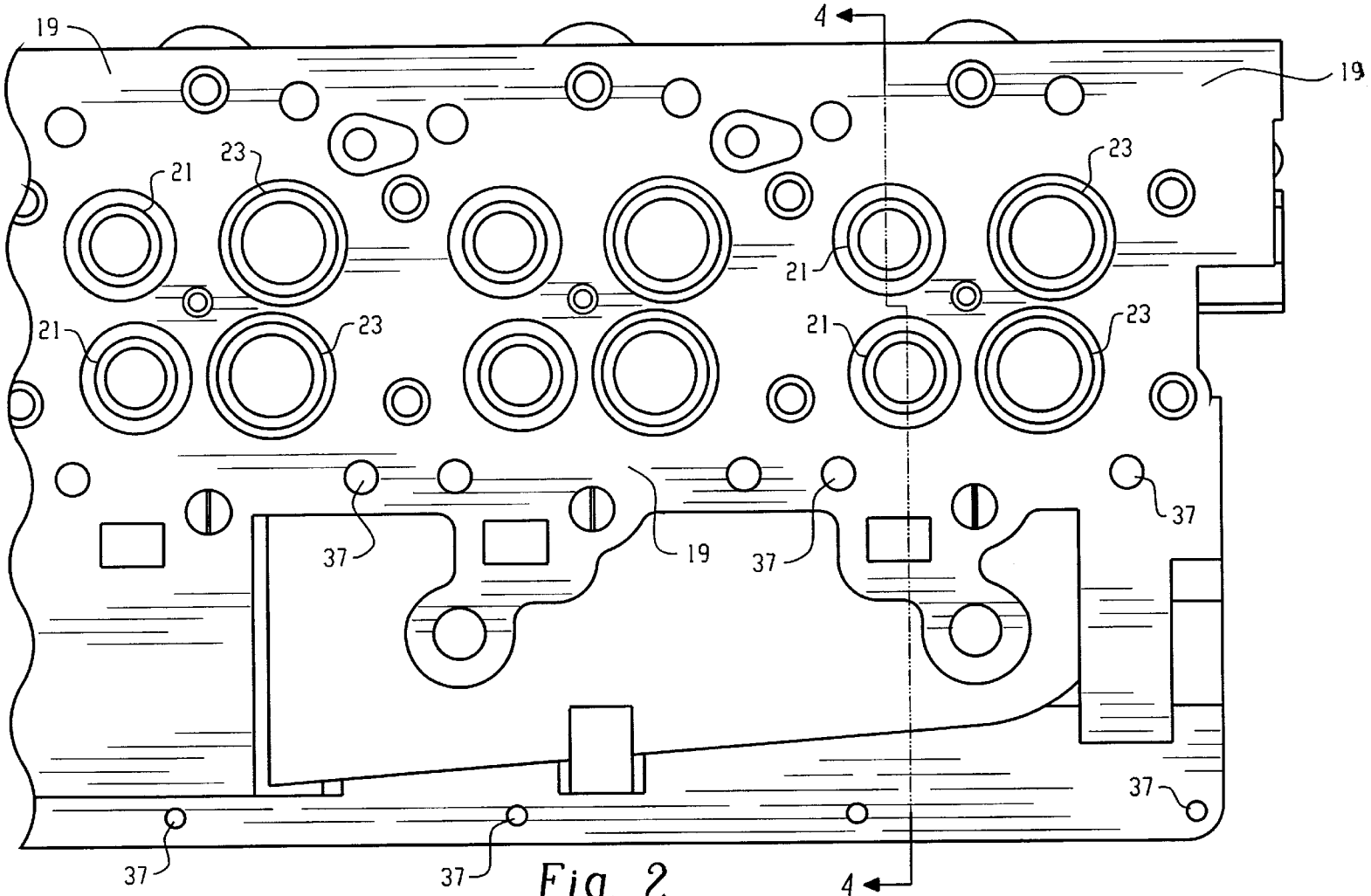
FIG. 2 is a fragmentary, bottom plan view of the cylinder head slab shown in FIG. 1, and on the same scale as FIG. 1.

Referring now primarily to FIGS. 1 and 2, the cylinder head slab subassembly 13 includes a cast head slab 17 including a combustion face 19, disposed to be in engagement with an upper surface of the cylinder block. By way of example only, the subject embodiment of the invention is an engine of the four-valve-per-cylinder type, such that for each cylinder in the engine block, there are two intake valves 21 and two exhaust valves 23. It should be noted that FIG. 4 shows only a pair of intake valves 21, but those skilled in the art will understand that, if the transverse cross-section were taken through the exhaust valves 23, FIG. 4 would look very similar, for purposes of the present invention. As may best be seen in FIG. 4, each of the intake valves 21 is seated, when in the closed position of FIG. 4, against a valve seat insert 25 which is received within the head slab 17, and provides a hardened, wear and corrosion resistant seat for the valves (which are also referred to as "poppet" valves).

Each of the valves (21 or 23) includes a valve stem 27, at the upper end of which is disposed a spring retainer 29, and seated against the underside of each of the retainers 29 is a valve return spring 31 (see also FIG. 1). Seated on the upper ends of each pair of poppet valves (i.e., intake valves 21 or exhaust valves 23) is a bridge member 33, the function of which, as is well know to those skilled in the art, is to facilitate the transmission of a cyclic, opening motion to two valves at once from a single "input". In the embodiment of FIGS. 1 through 4, the bridge members 33 remain in the positions shown in FIG. 1 merely by means of gravity.

It should be apparent to one skilled in the internal combustion engine art that the pattern or arrangement of each adjacent group of two intake valves 21 and two exhaust valves 23 will be disposed in a predetermined pattern which corresponds to the chamber pattern (referred to previously) defined by the combustion chambers of the cylinder block. The head slab 17 includes a plurality of bolts 35 (see FIG. 1), by means of which the entire cylinder head assembly 11 may be bolted to the cylinder block. The bolts 35 would typically pass through a head gasket (not shown herein) and extend into the cylinder block in a manner well know to those skilled in the art.

In addition, the head slab 17 defines a plurality of bolt holes 37 which define a bolt hole pattern. The purpose of the bolt holes 37 is to permit the valve activation module 15 to be bolted to the head slab subassembly 13 as will be described subsequently in connection with the method of the present invention. Note in FIGS. 1 and 2 that some of the bolt holes 37 are shown as being relatively smaller, while some are shown as being relatively larger, although such is not essential to the invention. As would be understood by those skilled in the art, there would typically be a gasket member (not shown herein) placed on the top surface of the head slab 17, before putting the valve activation module 15 in place, to prevent leakage of engine oil between the slab 17 and the module 15 while the engine is operating.

Referring now primarily to FIGS. 3 and 4, the valve activation module 15 will be described in some detail, it being understood that the module 15 shown in FIGS. 3 and 4 is by way of example only. The valve activation module 15 includes a module housing 41, which includes a series of rocker arm support portions 43. The support portions 43 have bolted thereto a plurality of rocker shafts 45, and in the subject embodiment, each rocker shafts 45 serves as the support for the rocker arms associated with two adjacent groups of rocker arms (i.e., the rocker arms necessary to actuate the valves for two adjacent cylinders), such that in the subject embodiment (in-line 6-cylinder engine), there would be three of the rocker shafts 45. Each group of rocker arms includes an intake valve rocker arm 47 and an exhaust valve rocker arm 49. As may best be seen in FIG. 4, each of the rocker arms 47 and 49 pivots about the rocker shaft 45, the pivot point being generally near the center of the respective rocker arm. Thus, the particular valve activation module 15 shown in FIGS. 1 through 4 may be referred to hereinafter as being of the "center-pivot rocker arm" type. Disposed between the intake and exhaust rocker arms 47 and 49 is a fuel injector rocker arm 51, although it should be understood by those skilled in the art that whether or not the module 15 includes a fuel injector rocker arm is not an essential feature of the invention.

Each of the rocker arms 47 and 49 is provided with an "elephant's foot" arrangement 53 which engages an upper surface 55 (see FIG. 1) of the bridge member 33. Each rocker arm 47 and 49 is provided, at the end opposite the elephant's foot 53, with a roller type cam follower 57 (shown only in FIG. 4) which remains in rolling engagement with a cam profile 59 on a cam shaft 60. The cam shaft 60 is rotatably supported at its axially opposite ends by circular openings 61 (see FIG. 3) in the module housing 41, only one of the openings 61 being shown in each of FIGS. 3 and 4.

Referring again primarily to FIG. 3, the module housing 41 defines a plurality of bolt holes 63 which, when the valve activation module 15 is aligned with the head slab subassembly 13, will align with the bolt holes 37. Thus, a plurality of bolts 65 (the only ones of the bolts 65 which are shown in FIG. 3 are those which pass through the rocker arm shafts 45) may be put in place through the holes 63 and threaded into the holes 37, securing the module 15 to the subassembly 13. It should be noted that in the embodiment of FIGS. 1–4, the bolts 65 are not all of the same length, and for each different valve activation module which may be utilized as part of this invention, the bolts 65 may be unique (i.e., in terms of length) for the particular valve activation module.

Figure 5:
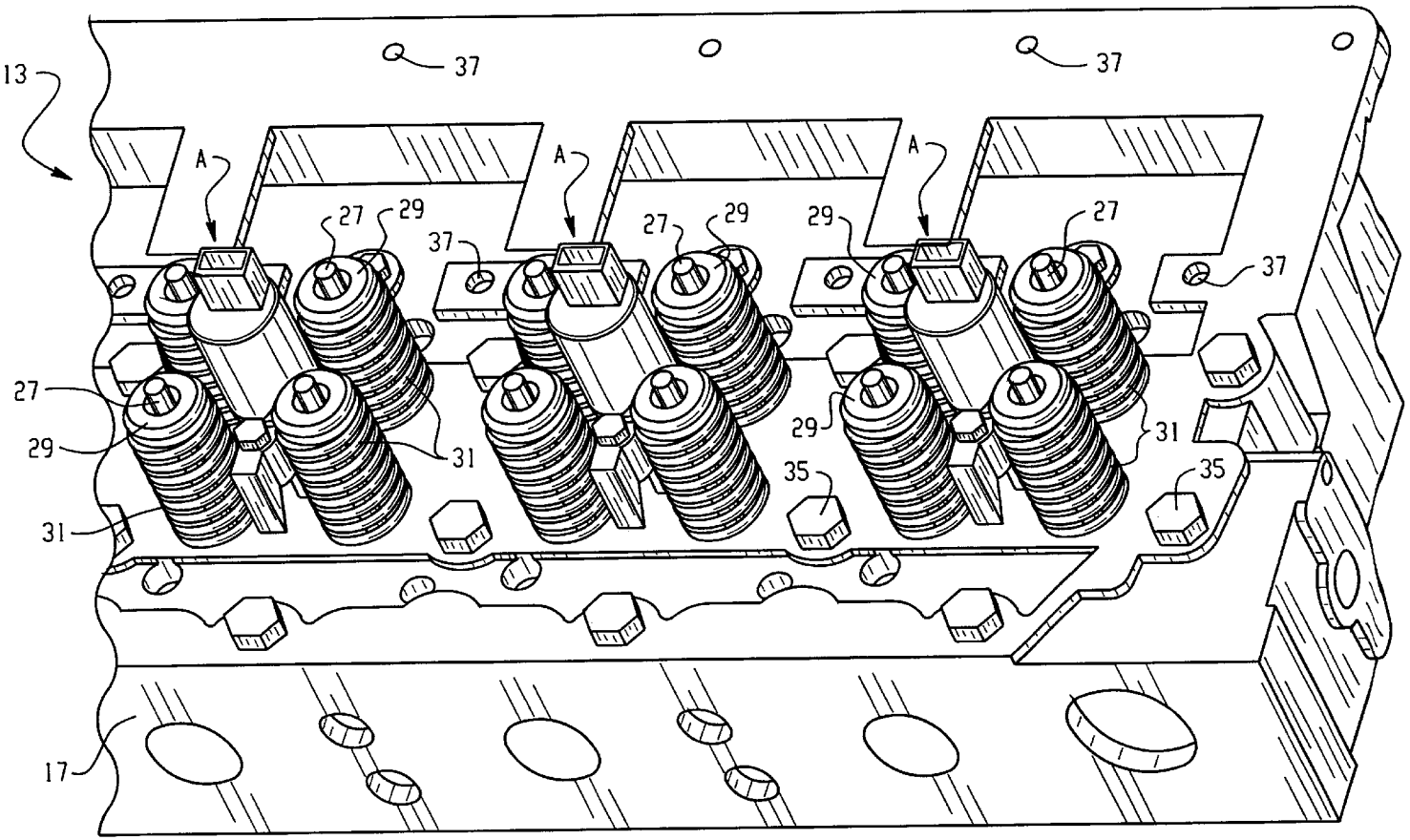
FIG. 5 is a fragmentary, perspective view of the cylinder head slab subassembly shown in FIG. 1, modified to accommodate the valve activation module of FIGS. 6 and 7.
Figure 6:
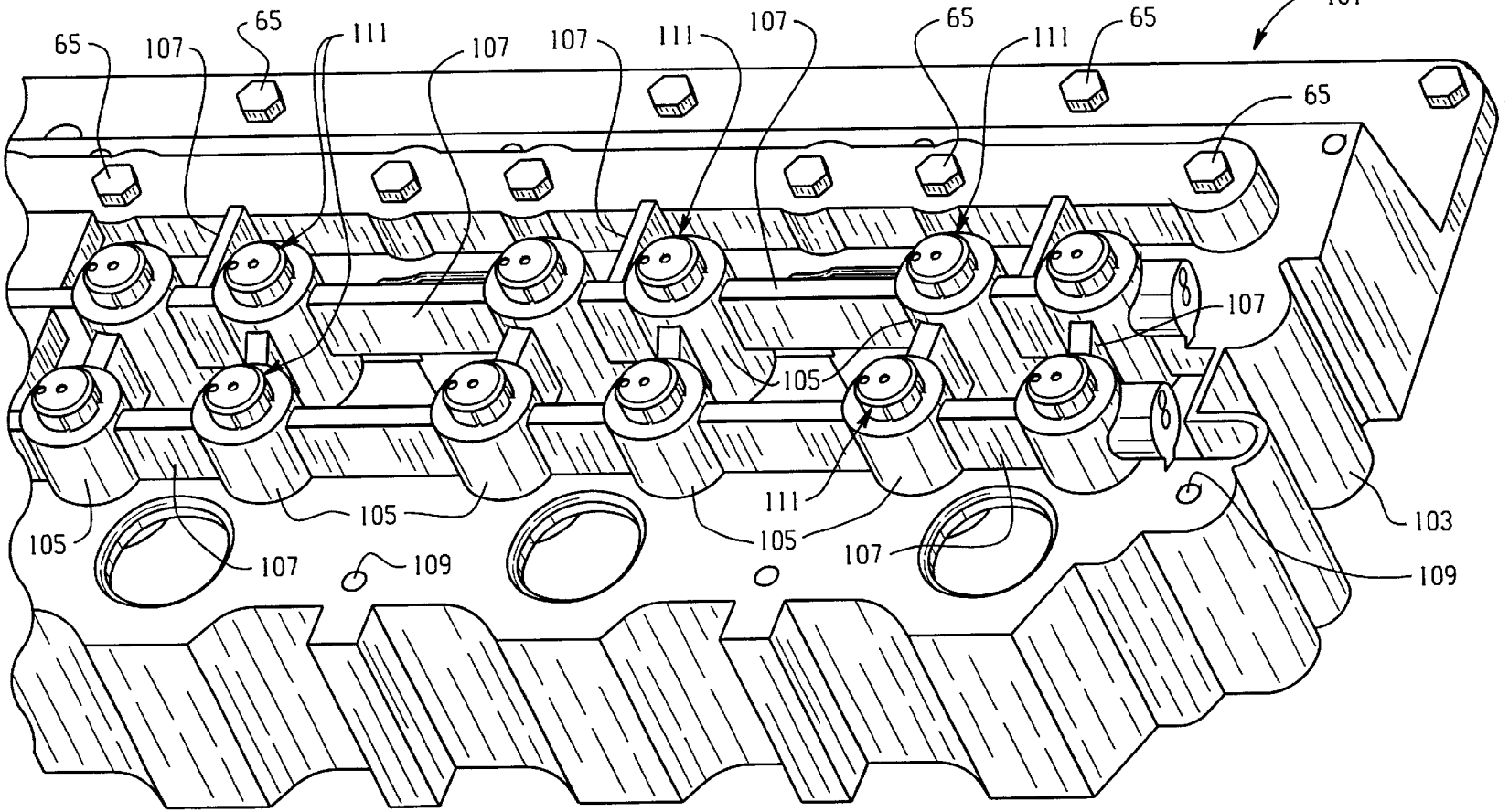
FIG. 6 is a fragmentary, perspective view, viewed in the same direction as FIG. 5, and on the same scale, of another embodiment of valve activation module for use as part of the present invention.
Figure 7:
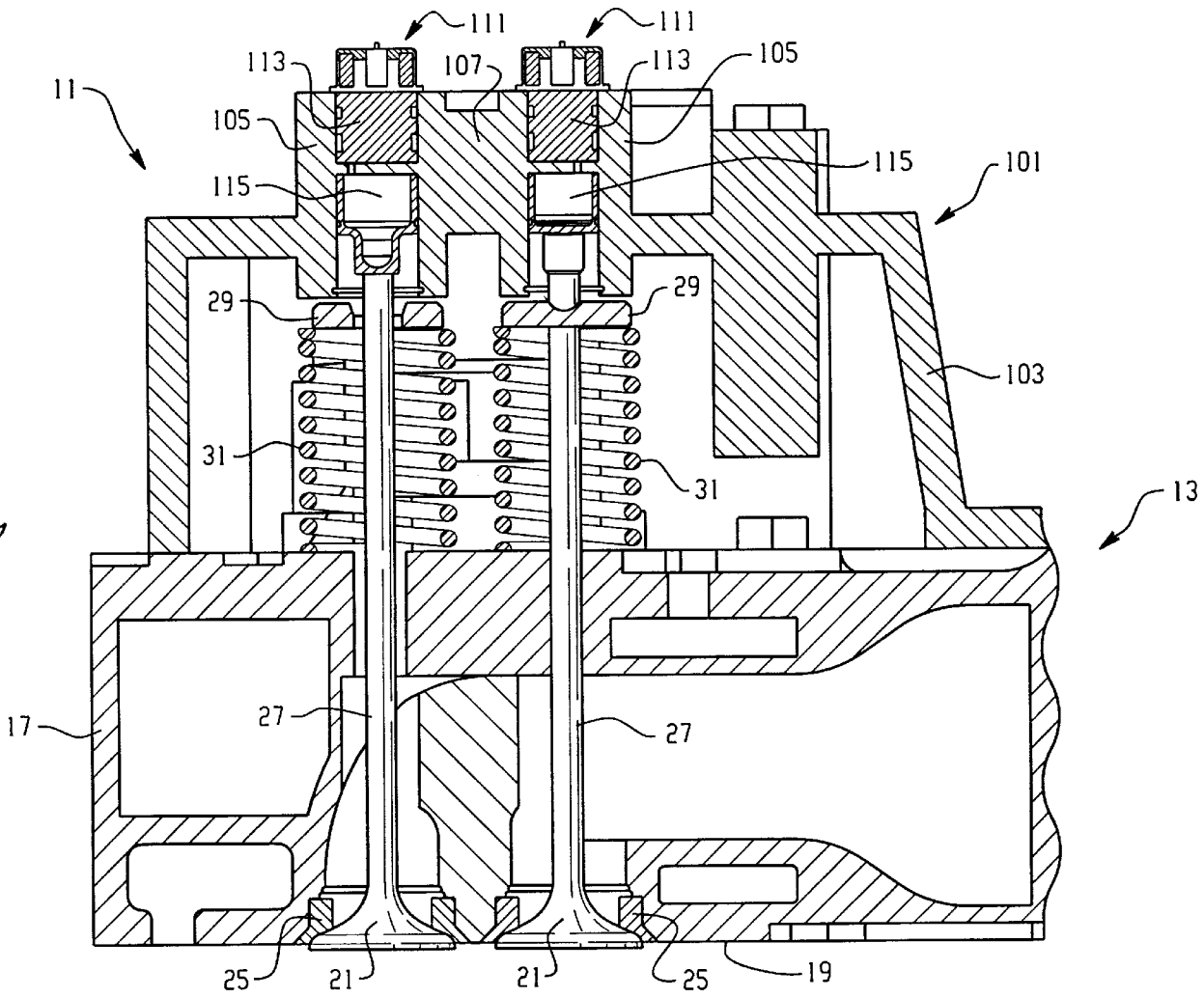
FIG. 7 is a somewhat enlarged, transverse cross-section, similar to FIG. 4, but with the valve activation module of FIG. 6 assembled to the cylinder head slab.

Referring now primarily to FIGS. 5–7, there will be described another aspect of the invention, i.e., another valve activation module providing a different valve gear train type or option. In FIGS. 5–7, the same or substantially similar elements will bear the same reference numerals as in FIGS. 1–4, and new or substantially modified elements will bear reference numerals in excess of "100".

By comparing FIG. 5 with FIG. 1, it may be seen that the two head slabs 17 are substantially identical, except that in FIG. 5, there is no bridge member 33 sifting atop each pair of adjacent valves (two intake valves 21 or two exhaust valves 23). Also, the fuel injector arrangement shown in FIG. 1, disposed to be engaged by the fuel injector rocker arm 51, is replaced in the version of the head slab shown in FIG. 5 by an electro-hydraulic fuel injector actuator A, shown somewhat schematically in FIG. 5, and shown herein by way of example only. It should be noted that the combustion face 19 for the head slab shown in FIG. 5 would probably be substantially identical to what is shown in FIG. 2, so that, in accordance with the present invention, either head slab could be used, with no modification required of the engine block.

Referring now primarily to FIGS. 6 and 7, there is shown a valve activation module 101 which includes a module housing 103. The module housing 103 has cast integral therewith a plurality of generally cylindrical actuator housing portions 105, separated and supported by a plurality of cast, integral support portions 107, the reference numeral "107" being used in FIG. 6 to designate several different structural elements, all of which perform the same function.

Referring now to FIG. 5, the head slab 17 includes a plurality of the bolts 35 by means of which, as in the first module, the entire cylinder head assembly may be bolted to the cylinder block. The head slab 17 also defines a plurality of the bolt holes 37, which define the bolt hole pattern, and by means of which the valve activation module 101 may be bolted to the cylinder head slab subassembly 13 of FIG. 5. Referring now to FIG. 6, the module housing 103 defines a plurality of bolt holes 109, at least some of which match up with the bolt hole pattern defined by the bolt holes 37, in the same general manner as in FIG. 3 in which at least some of the bolt holes 63 match up with the bolt hole pattern defined by the bolt holes 37. In FIG. 6, a number of the bolt holes 109 are "hidden" by the presence of bolts 65 which are in threaded engagement with corresponding bolt holes 37 in the head slab subassembly.

Referring again primarily to FIGS. 6 and 7, disposed within each of the cylindrical actuator housing portions 105 is an hydraulic valve actuator 111, the actuator 111 including two primary portions: an electro-magnetically operated valve portion 113 and a piston-like actuator portion 115. As may best be seen in FIG. 7, the bottom end of each actuator portion 115 is in engagement with the upper end surface of the respective valve stem 27, whereby actuation of the valve portion 113 results in the communication of pressurized fluid into the interior cavity defined by the actuator portion 115. The presence of pressurized fluid within the actuator portion 115 biases it downwardly, overcoming the biasing force of the valve return spring 31, and opening the respective intake valve 21. It should be understood that, in the subject embodiment of the valve activation module 101, the structure for actuating the exhaust valves 23 is substantially identical to that shown in FIG. 7 for actuating the intake valves 21, and therefore, is not separately illustrated and described herein.

It should also be understood by those skilled in the art that the specific structure of the hydraulic valve actuators 111 is not an essential feature of the present invention, and within the scope of the invention, various types and configurations of valve actuators could be provided. It is not even essential to the invention that the actuators 111 be hydraulic, but instead, they could comprise electromagnetic actuators, or any other suitable actuator of the type which does not require a camshaft. Thus, one purpose in illustrating the valve activation module 101 is merely to give a generic example of a module in which the valve gear train is of the "camless" type. Furthermore, it is not an essential feature of the invention that one of the modules be of the cam and rocker arm type, while the other module be of the direct actuation, hydraulic or electromagnetic type. Instead, these two different module types are illustrated and described herein simply to help with an understanding of the range of different module types which can be utilized as part of the present invention.

An important aspect of the present invention, which will now be described, is the method of assembling the cylinder head assembly 11, in preparation for bolting the head assembly 11 to the engine block (not shown herein). The first step is to provide the head slab sub-assembly 13, which includes the predetermined pattern of intake valves 21 and exhaust valves 23, to correspond to the chamber pattern defined by the combustion chambers. As part of the step of providing the head slab sub-assembly 13, it would also be necessary to make any modifications appropriate to the particular valve activation module which will be used. For example, it may be necessary to provide the fuel injection arrangement shown in FIG. 1, or the fuel injector actuators A shown in FIG. 5.

As was noted previously, the head slab 17 defines the plurality of bolt holes 37 which define the bolt hole pattern. The next step in the assembly method is to provide a plurality of valve activation modules (15 and 101), and although only two have been illustrated and described herein up to this point, those skilled in the art will understand that the more types of valve activation modules provided, the greater will be the benefit of the invention. It should also be apparent to those skilled in the art that, in order for the present invention to be used successfully, each valve activation module must be designed such that the final actuation portions (e.g., the elephant's foot 53 or the piston-like actuator portions 115) match up to the corresponding structure (e.g., the bridge member 33 or the valve stems 27) on the head slab sub-assembly.

The next step in the assembly method is to select the desired valve activation module 15 or 101, and bolt it to the head slab 17. It should be understood that this "selection" step may literally involve an operator choosing from two or more different modules as a series of the head slab subassemblies 13 move past the operator on a head assembly line. Alternatively, the "selection" step could involve directing a quantity of engine blocks to two different assembly areas within an engine assembly plant, and in one, assembling the head slab sub-assembly of FIG. 1 with the module 15, and in another, assembling the head slab sub-assembly of FIG. 5 with the module 101. Finally, the "selection" process as described previously could involve the same general steps, but with the one assembly area being in one geographic location, and the other assembly area being in another geographic location. All that is essential to the method of the invention is that there be the ability to assemble two or more cylinder head assemblies, each having a different valve gear train type, starting with a common, basic head slab.

In the case of the valve activation module 101, or any other module involving electrical control, one step in the assembly process is to make appropriate electrical connections. With the module 101, it would be necessary to connect the fuel injector actuators A to the engine microprocessor or controller, as would be readily understood by those skilled in the art.

Figure 8:
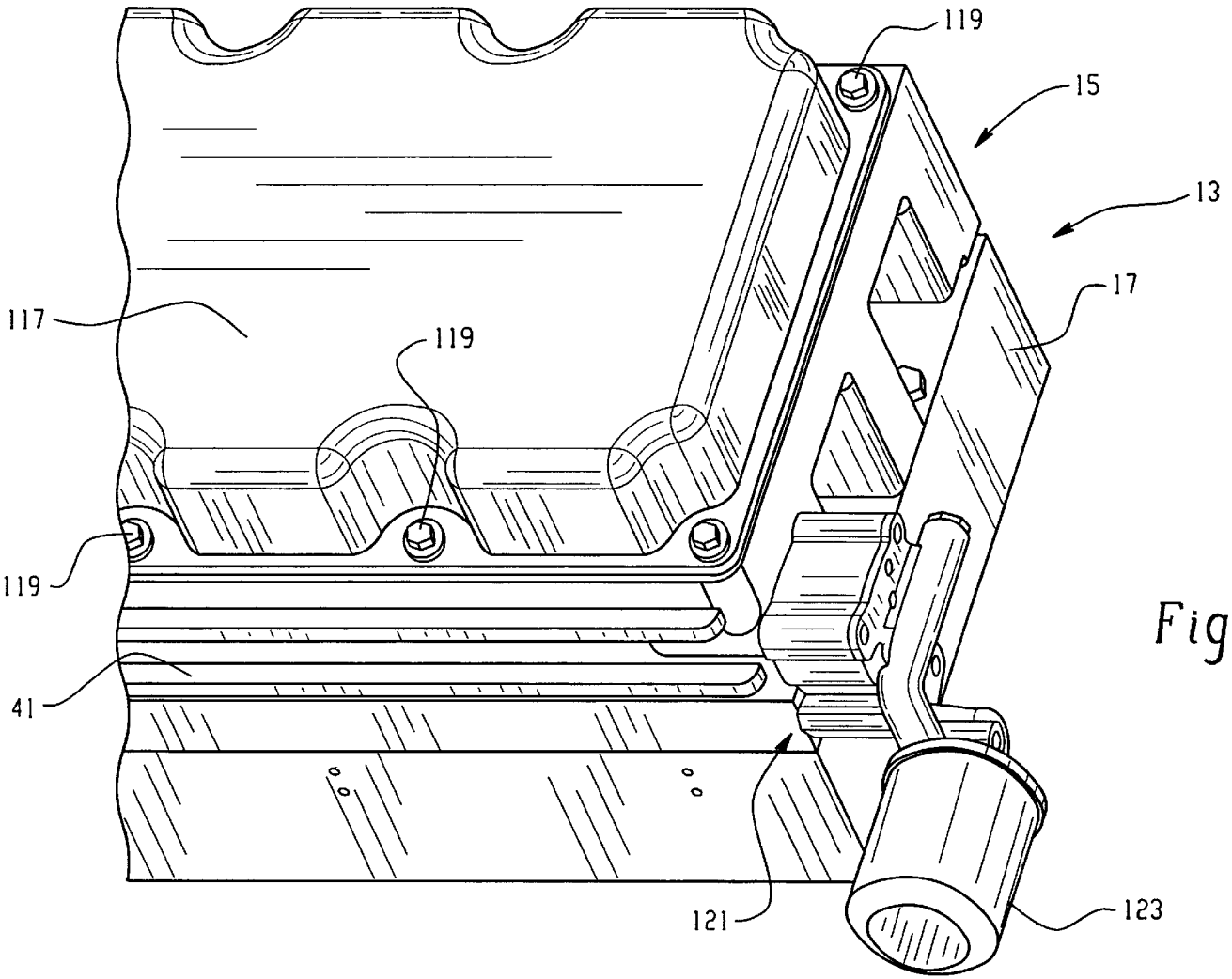
FIG. 8 is a fragmentary, perspective view, looking at what would be the rearward, left-hand corner in FIG. 1, illustrating one of the lubrication options possible with the present invention.

The final step in the assembly method is to provide a valve cover appropriate for the selected valve activation module, and attach (typically by bolting) the valve cover to the assembled cylinder head. Referring now primarily to FIG. 8, there is illustrated a view of the entire cylinder head slab subassembly 13 after a valve cover 117 has been bolted to the module housing 41 by means of a plurality of bolts 119. Those skilled in the engine assembly art will understand that, as a practical matter, it may typically be necessary to bolt the subassembly 13 to the engine block, by means of the bolts 35, and then bolt the valve cover 117 to the module housing 41.

Another purpose for including FIG. 8 is to illustrate one aspect of a lubrication alternative which is useable as part of the present invention. In FIG. 8, what is being shown is a self-lubricated, self-contained cylinder head slab subassembly, i.e., one in which the head subassembly 13 does not share an engine oil supply with the block, but instead, has its own oil supply and is sealed from fluid communication with the block. Typically, in a conventional lube type engine, the engine oil is communicated between the block and the head through passages which flow through openings in the head gasket. In order to provide a self-lubricated head subassembly, it is possible simply to utilize a different head gasket which permits no flow between the block and the head, or alternatively, the various oil passages in the block and in the head could also be plugged (i.e., either in addition to, or instead of, the modified gasket).

In order for the head subassembly 13 to be self-lubricated, there may be provided a separate oil pressure source, just for the head subassembly 13. As shown in FIG. 8, a pumping element 121 may be attached to the "rearward" end of the camshaft 60, i.e., the end opposite the end which would be received within the opening 61 shown in FIG. 3. Those skilled in the pump art will understand that what is shown in FIG. 8 is merely the housing for the pumping element 121, and that the choice of the particular element is not an essential feature of the invention. By way of example only, the element 121 could comprise a gear pump, or a gerotor pump of the fixed axis type, or any other suitable element. Connected hydraulically to the pumping element 121 is a fluid reservoir 123, which is able to provide a source of fluid available at the inlet of the pumping element 121, to be drawn into the element as it rotates.

Figure 9:
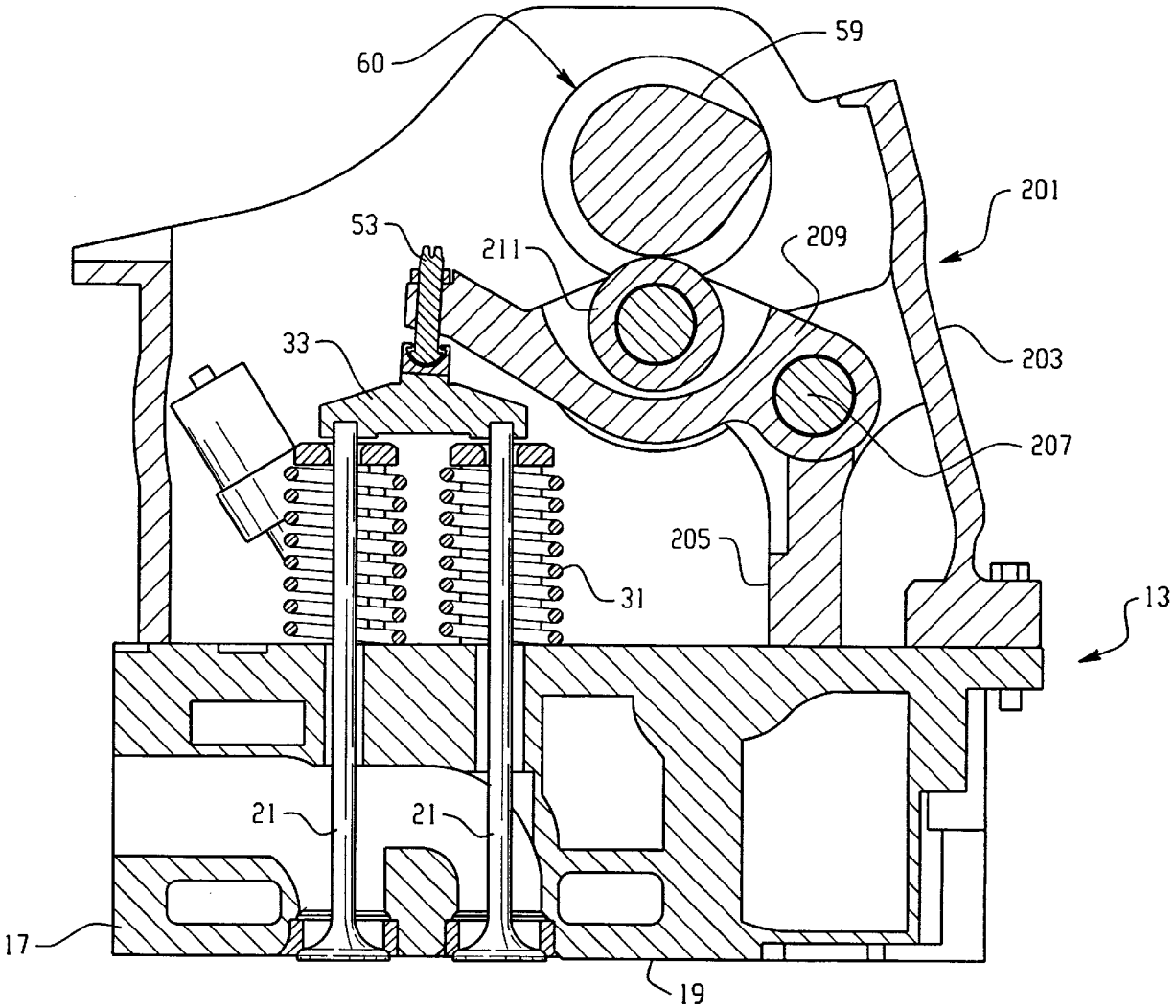
FIG. 9 is a somewhat enlarged, transverse cross-section, similar to FIGS. 4 and 7, but illustrating an alternative embodiment of valve activation module useable as part of the present invention.

Referring now primarily to FIG. 9, there is illustrated an alternative embodiment of valve activation module, generally designated 201. The module 201 includes a module housing 203, and formed integrally therewith, a series of rocker arm support portions 205, each of which supports a rocker shaft 207. Pivotally disposed on each rocker shaft 207 is one or more rocker arms 209, which therefore may be referred to as being of the "end pivot rocker arm" type. Each rocker arm 209 has rotatably mounted thereto a roller type cam follower 211, for engagement with the cam profile 59 on the camshaft 60. In order for there to be the selectivity in the assembly method of the present invention, the end of each rocker arm 209, opposite the rocker shaft 207, has the same elephant's foot 53 which was described previously in connection with FIGS. 1 through 4. It should be apparent to those skilled in the engine art that what is important, as far as the selectivity in the assembly method, is not the presence of the elephant's foot 53, but instead, that each module (15 or 201) include the same mechanism for interfacing with the head slab subassembly 13, and in the subject embodiment, and by way of example only the interface is the elephant's foot 53.

Figure 10:
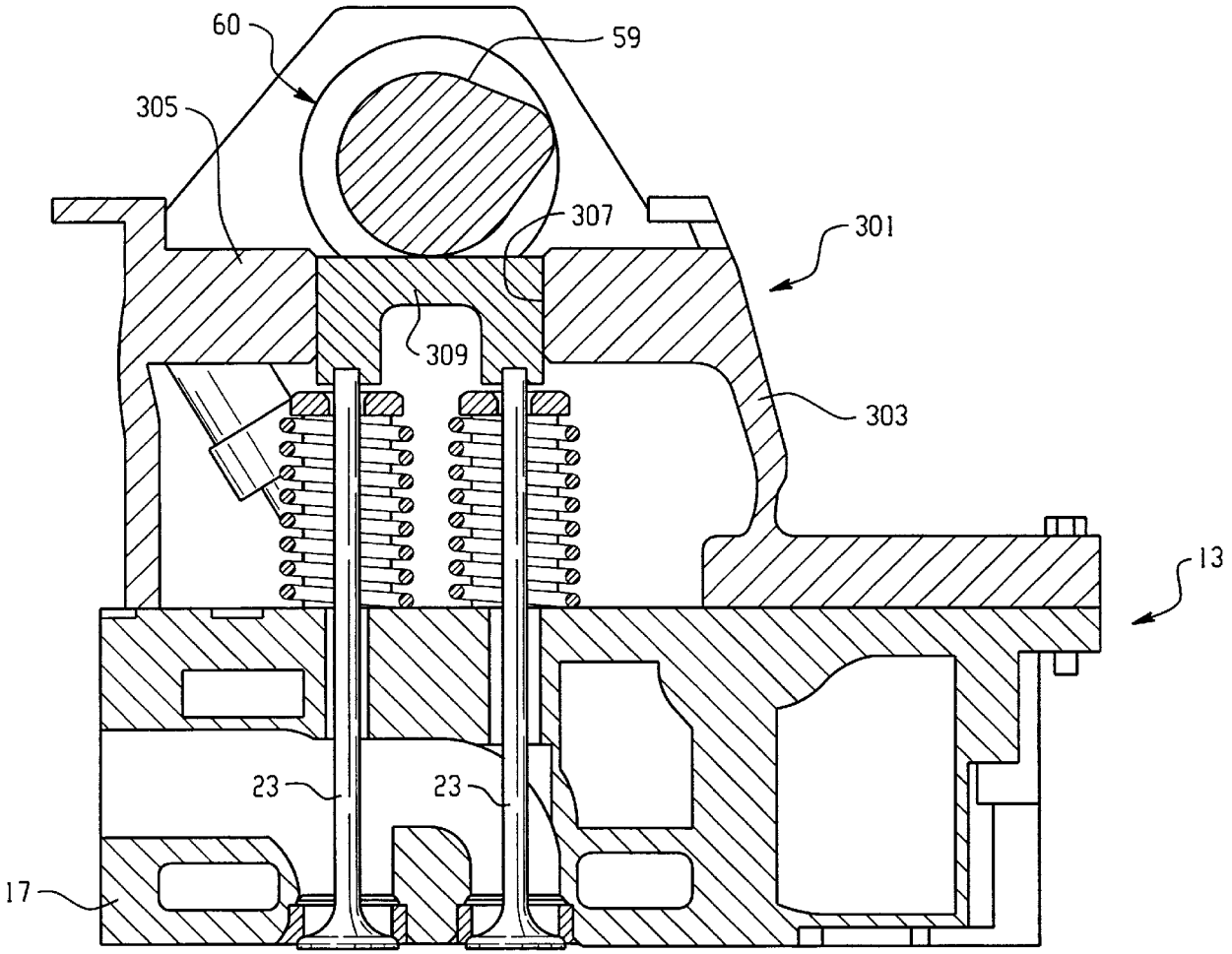
FIG. 10 is another somewhat enlarged, transverse cross-section, similar to FIG. 9, but illustrating another alternative embodiment of valve activation module useable as part of the present invention.

Referring now primarily to FIG. 10, there will be illustrated another embodiment of valve activation module, generally designated 301, which is included partly to explain that within the scope of the invention, the module which includes a camshaft 60 doesn't have to have a valve gear train of the rocker arm type. Instead, in the embodiment of FIG. 10, the valve gear train is of the "direct-acting" type, which, as is well known to those skilled in the engine art, is a valve gear train of the cam type, but which does not require any rocker arms. The valve activation module 301 includes a module housing 303, including an upper portion 305 which defines an opening 307, adjacent each pair of valves (intake valves 21 or exhaust valves 23). Reciprocably disposed within each opening 307 is a bridge-type tappet member 309 which directly engages the tip portion of each of the valves (shown in FIG. 10 as exhaust valves 23). In a manner well known to those skilled in the art, the upper surface of the tappet member 309 is directly engaged and driven by the rotating cam profile 59 on the camshaft 60.

Each of the modules illustrated and described hereinabove has been shown as being of the "fixed" type, i.e., in each valve gear train, the relationship between, for example, valve opening and camshaft rotation is a fixed relationship. However, as should be understood by those skilled in the engine art, the camless type of valve gear train is inherently capable of VVA/VVT (variable valve actuation/variable valve timing) operation, in which the amount of valve opening, and/or the timing of the valve opening, can be varied as a function of, for example, engine speed. In addition, as should also be understood by those skilled in the engine art, each of the cam type valve gear trains shown herein could, within the scope of the present invention, be provided with some sort of VVA/VVT capability, the specific construction details of which form no part of this invention, and therefore, will not be described further herein. What is important for purposes of the present invention is that the engine OEM now has the capability of offering, for example, a basic engine cylinder head slab, on which either of two modules can be assembled: one would be a simple, fixed valve gear train (for example, of the end-pivot rocker arm type) and the other would be the same valve gear train, but including some sort of VVA/VVT capability.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A method of assembling a cylinder head assembly for use with a cylinder block of an internal combustion engine, the cylinder block defining a plurality of combustion chambers defining a chamber pattern; the method comprising the steps of:

(a) providing a cylinder head slab to be attached to the cylinder block, and including a predetermined pattern of intake and exhaust poppet valve assemblies corresponding to the chamber pattern defined by the combustion chambers;

(b) providing said cylinder head slab with a plurality of bolt holes defining a bolt hole pattern;

(c) providing a plurality of valve activation modules A and B in which each of said valve activation modules A and B comprises a housing and a plurality of valve actuators corresponding to said predetermined pattern of intake and exhaust poppet valve assemblies;

(d) selecting a module from said plurality of valve activation modules A and B, each of said valve activation modules defining a plurality of bolt holes which correspond with at least a major portion of the bolt holes in said bolt hole pattern defined by said cylinder head slab; and (e) bolting said selected module A or B to said cylinder head slab.

2. A method as claimed in claim 1, characterized by said step of bolting said selected module A or B to said cylinder head slab includes the additional step of attaching a valve cover corresponding to said selected module.

3. A method as claimed in claim 1, wherein each of said valve activation modules A and B is a member selected from the group consisting of: a module having a valve gear train of the center-pivot rocker arm type, a module having a valve gear train of the camless type, a module having a valve gear train of the end-pivot rocker arm type, and a module having a valve gear train of the direct-acting cam type.

4. A method as claimed in claim 3, wherein each member of the group comprises a module selected from the group consisting of a valve gear train of the fixed type, and a valve gear train of the variable valve actuation/variable valve timing type.

5. A method as claimed in claim 3 wherein each member of the group may comprise a module which provides the cylinder head assembly with a conventional lubrication system, or may comprise a module which provides the cylinder head assembly with a self-lubrication capability.

6. A method of assembling a cylinder head assembly for use with a cylinder block of an internal combustion engine, the cylinder block defining a plurality of combustion chambers defining a chamber pattern; the method comprising:

(a) providing a cylinder head slab adapted to engage and be attached to the cylinder block, and including a predetermined pattern of intake and exhaust poppet valve assemblies corresponding to the chamber pattern defined by the combustion chambers;

(b) providing said cylinder head slab with a plurality of bolt holes defining a bolt hole pattern;

(c) providing a plurality of valve activation modules A and B in which each of said modules A and B comprises a housing, and in said module A, providing said housing with a plurality of rocker arm support portions and a plurality of rocker arms corresponding to said pattern of intake and exhaust poppet valve assemblies, and in said module B, providing said housing with a plurality of actuator housing portions and a plurality of actuators corresponding to said pattern of intake and exhaust poppet valve assemblies;

(d) selecting a module from said plurality of valve activation modules A and B, each of said valve activation modules defining a plurality of bolt holes which correspond with at least a major portion of the bolt holes in said bolt hole pattern defined by said cylinder head slab; and (e) bolting said selected module A or B to said cylinder head slab.

* * * * *